United States Patent [19]

Tanaka

[11] 4,013,857

[45] Mar. 22, 1977

[54] ILLUMINATION-TYPE SMALL-SIZED SWITCH

[75] Inventor: Yukihisa Tanaka, Tokyo, Japan

[73] Assignee: Nihon Kaiheiki Industrial Company, Ltd., Tokyo, Japan

[22] Filed: May 14, 1975

[21] Appl. No.: 577,206

[30] Foreign Application Priority Data

June 12, 1974 Japan ..... 49-67364[U]

[52] U.S. Cl. ..... 200/315; 240/151

[51] Int. Cl.[2] ..... H01H 9/16

[58] Field of Search ..... 200/308–317; 339/113 L; 240/151, 152; 340/381

[56] References Cited

UNITED STATES PATENTS

| | | | |
|---|---|---|---|
| 3,598,950 | 8/1971 | Ohashi | 200/315 |
| 3,609,268 | 9/1971 | Sanchez | 200/315 |
| 3,735,077 | 5/1973 | Ohashi | 200/315 |

*Primary Examiner*—James R. Scott
*Assistant Examiner*—Morris Ginsburg
*Attorney, Agent, or Firm*—Pierce, Scheffler & Parker

[57] ABSTRACT

The illumination-type, small switch of the present invention is characterized by disposing the light emitter in a resilient sleeve-like support fixed to the upper surface of an insulating plate.

8 Claims, 10 Drawing Figures

ILLUMINATION-TYPE SMALL-SIZED SWITCH

This invention relates to the electric switch art, and is concerned with a construction of the illuminating portion of a switch in which beneath an actuator there is provided a light emitter — such as an incandescent lamp, a neon lamp or a light-emitting diode —, and the actuator is illuminated by the projecting rays of the light emitter to clearly indicate the "on" and "off" positions.

The invention will now be described, with reference to the accompanying drawing, in which.

Figure 1:
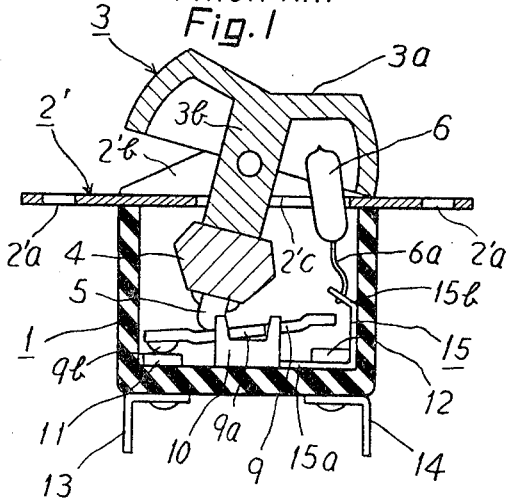
PRIOR ART Fig. 1
FIG. 1 is a sectional front view of a prior art switch.

In prior switches of the general kind above-mentioned, as shown in FIG. 1, lead wires of the light emitter were utilized also for securing it. In this figure representing the prior art, 1 is a switch case of insulating material, on the upper open end of which is fixed a planar mounting plate 2'. This plate has as its object to mount the subject switch on the surface of another body such as a panel, — that is, the mounting plate is fixed on the panel by screw fasteners inserted in the left and right holes 2'a, 2'a. Centrally on front and rear ends of mounting plate 2' there are formed rising pieces 2'b, and the actuator 3 is supported left-and-right rockably on a shaft journaled into upper central holes in the rising pieces. A converter 4 is connected to the actuator 3 at its lower end, and plungers 5 are inserted into recesses provided on the lower surface of converter 4 with the intervention of compression springs (not shown).

Centrally on the inner base surface of case 1, in said prior art construction, there is secured a bearing piece 10 for a movable contact piece 9, on the upper surface of which said movable contact piece is borne rockably left-and-right. That is, the bearing piece 10 is formed in the shape of a channel when it is seen from transverse, and on the central recesses of the upper surfaces of the front and rear rising pieces of the bearing piece there are seated front and rear projections 9a formed at the central portion of the movable contact piece 9. To the left of bearing piece 10 there is provided a left side stationary contact piece 11 which is shaped as a rivet, and the lower end of which is fixed by calking to the lower surface of case 1 together with a left side terminal piece 13. To the right of bearing piece 10 likewise there are fixed a right side stationary contact piece 12 of rivet shape, and a right side terminal piece 14 on the lower surface of the case. Between the head portion of the rivet-shaped contact piece 12 and the inner base surface of the case there is interposed the bottom portion 15a of an L shaped conductor piece 15. The bottom portion 15a is formed continuously with, and as the rightward extended portion of, the bottom portion of bearing piece 10. The plunger 5 is placed on the upper surface of movable contact piece 9 slidably left-and-right. The contact 9b fixed on the lower surface of the left end of movable contact piece 9 is adapted to contact with, and separate from, the left side stationary contact piece 11. The above-mentioned contact pieces 9, 11 and 12, bearing piece 10 and terminal pieces 13 and 14 constitute as a whole an assembly and two such assemblies are provided in the front and rear sections of the switch.

The actuator 3 is shown as a wave form bottom having its upper surface 3a shaped like a wave, and projected downwards from the central portion of its lower surface there is formed a columnar portion 3b. In the mounting plate 2' there is provided a hole 2'c for inserting the columnar portion 3b, and the lamp 6 for illuminating the actuator 3 also is inserted in the hole 2'c. Actuator 3 is made of transparent or semi-transparent material, and lamp 6 is disposed below the back surface of actuator 3 to illuminate its upper surface portion 3a and other portions. The lead wire 6a of lamp 6 is fixed by soldering directly to the bent upper end portion 15b of conductor piece 15,— that is, the lead wire 6a functions as the electrical connection of lamp 6 and simultaneously also as its mechanical support.

In the above-mentioned prior construction, since the position or height of lamp 6 is affected by the height or the elastic strength or the like of the lead wire 6a, it is difficult to fix the position at a constant point most suitable for the illumination of actuator 3. Further, since there is nothing to suppress lamp 6 when impulse or vibration is given to the switch, the position of the lamp is deviated to remarkably lower the illumination effect, and further even there was fear that the lead wire would be broken off. Especially, since a small sized lamp or a neon lamp used here is of lower candle power, it is an important matter to fix it at a position of good light-emitting effect. Further, since lead wire 6a and conductor 15 are soldered together, when soldering is performed on the external terminal piece 14 for wiring connection, heat from the soldering iron is conducted to the interior so that soldering mass at the lower end of lead wire 6a may be melted off: such trouble has sometimes occurred that the lead wire is separated from conductor piece 15. Furthermore, the soldering operation in such a narrow place as in the interior of case 1 is difficult and requires very much labor.

An object of the present invention is to remove the above-mentioned defects, and its basic feature resides in providing a resilient cylinder-shaped rising piece on an insulator plate specially provided or already existing, and fitting therein a light emitter for illuminating the actuator.

In this disclosure the expression "cylinder-shaped" is intended to mean the form of an enlongated body having a constant cross-sectional configuration, whether that cross-section be circular or rectangular or other.

Figure 2:
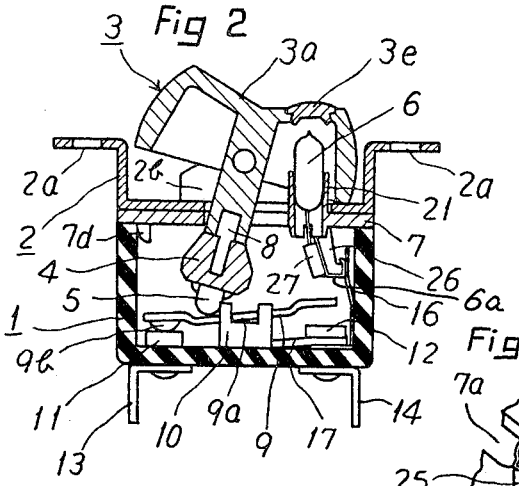
FIG. 2 is a sectional front view of a switch according to the present invention.

In FIG. 2 which shows an embodiment of the invention, case 1 having provided on its base surface movable contact piece 9, stationary contact pieces 11, 12 etc. and actuator 3, converter 4 etc. are substantially the same as those shown in FIG. 1, the main difference therebetween residing in the additional provision of a cover plate 7 of insulating material interposed between case 1 and overlying mounting plate 2 and a construction for stably mounting thereon the light emitter 6.

Figure 3:
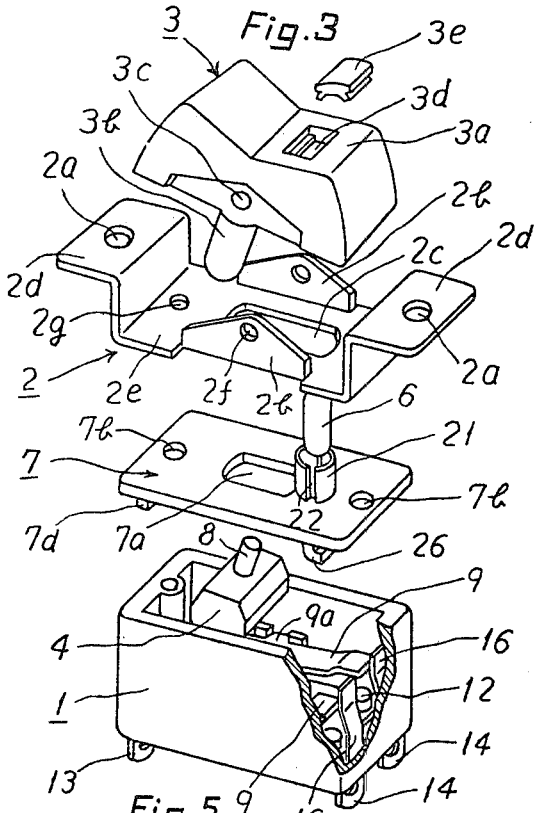
FIG. 3 is an exploded perspective view of the structure illustrated in FIG. 2.

In FIG. 3, the mounting plate 2 is made in the shape of a channel having flanges 2*d* having holes 2*a* for mounting to a panel. Centrally on front and rear edges of base portion 2*e* of mounting plate 2 there are formed rising pieces 2*b* in which at its upper central portion holes 2*f* for journaling a shaft are opened. On the other hand, in the column portion 3*b* projecting downwards from the central portion of the back surface of actuator 3 formed in the shape of a wave-form bottom there is opened a hole 3*c* in the front and rear direction, and by journaling a shaft-rod into this hole 3*c* and the above-mentioned holes 2*f* and the actuator 3 is supported rockably left-and-right about the shaft-rod. Alternatively, instead of the shaft rod the construction may take such form that on the front and rear surfaces of actuator 3 there are provided shaft-shaped small lugs which are inserted resiliently into holes 2*f*. In the base plate portion 2*e* of mounting plate 2 there is opened a hole 2*c*, a little deviated to the right, for inserting column portion 3*b* and lamp 6, and positioned therefrom to the left and right there are opened holes 2*g* for inserting screw fasteners to secure the mounting plate 2 to case 1.

Centrally on cover plate 7 there is a hole 7*a* for inserting column portion 3*b* therethrough, and positioned therefrom to the left and right there are holes 7*b* for inserting screw fasteners to secure cover plate 7 and mounting plate 2 to case 1. On the lower end surface of column portion 3*b*, which penetrates through hole 7*a* and goes into case 1, and on the upper end surface of converter 4 provided thereunder, there is formed each a recess, and a pin 8 — which is shaped so as to conform with the recesses — connects them as shown in FIG. 2. Alternatively, pin 8 may be formed in one body with actuator column portion 3*b* as its extended projecting portion, or all of column portion 3*b*, pin 8 and converter 4 may be made as a continuous single body.

Figure 5:
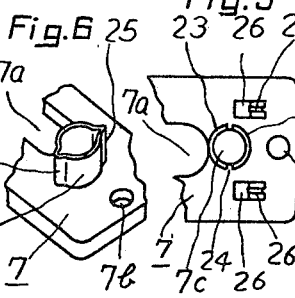
FIG. 5 is a bottom view of an essential portion.
Figure 6:
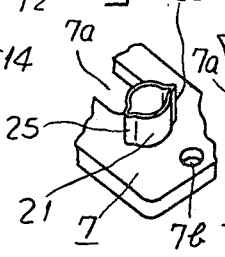
FIG. 6 is a perspective view of another embodiment of the essential portion of the switch structure.
Figure 4:
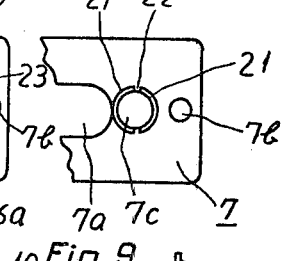
FIG. 4 is a plan view of an essential portion of the structure.

As shown in FIG. 4, in close proximity with the right end of central hole 7*a* of cover plate 7 there is a circular hole 7*c*, and so as to surround it there is formed projecting upwards from the upper surface of cover plate 7 a rising piece 21 in the shape of a cylinder divided into two parts continuously as one body with cover plate 7. This rising piece 21, because of having longitudinal splits 22 between the two parts, has sufficient elastic flexibility. Into this rising piece 21 is resiliently fitted the lamp 6. Also, as shown in FIGS. 2 and 5, on the back surface of cover plate 7 and projecting a little downwards therefrom, there is formed a projecting piece 23 in the shape of a cylinder divided into two parts, which is positioned in vertical alignment with the upper rising piece 21 and has also longitudinal splits 24. This downward projecting piece 23 is convenient in containing lamp 6 when it is vertically longer as compared with rising piece 21, but it may be omitted in some cases. Alternatively, instead of providing splits 22 and 24 in rising piece 21 and downward projecting piece 23, respectively, some number of longitudinal folds 25, as shown in FIG. 6, may be provided thereby to give sufficient resiliency.

Figure 7:
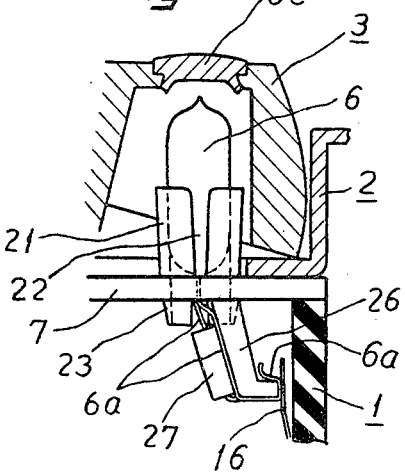
FIG. 7 is an enlarged front view of an essential portion.
Figure 8:
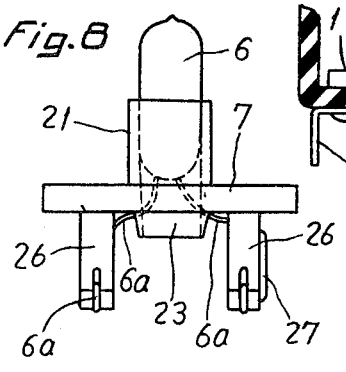
FIG. 8 is an enlarged side view of an essential portion.

Further, on the back surface of cover plate 7, as shown in FIGS. 5, 7 and 8, in front and rear of projecting piece 23 there are formed two leg pieces 26 as one body with and projecting from cover plate 7. Each of these leg pieces, as shown in FIG. 7, extends from the lower surface of cover plate 7 a little obliquely to the right and downwards, and is bent at its lower end to the right, its extremity extending to the position close to the inner side surface of case 1 to confront thereto. Each of lead wires 6*a* of lamp 6 is conducted out along the surface of leg piece 26, and in order to fit lead wire 6*a* therein there is provided along its path a groove 26*a* (FIG. 5) partially on the surface of leg piece 26. In order to electrically conduct out lead wire 6*a* to external terminal piece 14, as shown in FIG. 2, an L-shaped resilient conductor piece 16 is mounted on the inner base surface of case 1.

In FIG. 2, the conductor piece 17 which extends to the right from the base plate portion of bearing piece 10 and is connected with the right side stationary contact piece 12 and the terminal piece 14 ends remaining horizontal, and between this conductor piece 17 and the inner base surface of the case there is interposed the base plate portion of L-shaped conductor piece 16 which is fixed together with the others. The vertically formed end portion of lead wire 6*a* resiliently contacts with the upper end portion of conductor piece 16 which has much resiliency, where an electrical connection requiring no soldering is performed.

In this embodiment, since lamp 6 is assumed as a neon lamp, a series resistor 27 therefor is connected with one of lead wires 6*a*, and this resistor 27 is disposed along the left side surface of either one of front and rear leg pieces 26.

In FIG. 2 and FIG. 3, on the left side lower surface of cover plate 7 there are provided projecting therefrom two, — front and rear, — pawl pieces 7*d*, in order to facilitate the positioning of cover plate 7 relative to case 1. Alternatively, the above-mentioned two leg pieces 26 may be replaced by one wide leg piece.

Figure 9:
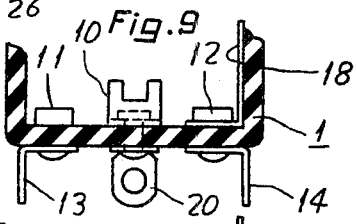
FIGS. 9 and 10 are partial sectional front views of two other embodiments of the invention.
Figure 10:
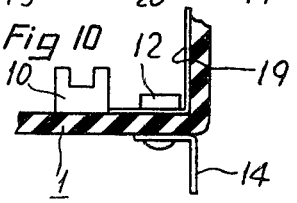

Although in FIG. 2, resiliency of conductor piece 16 is utilized for resilient contact of lead wire 6*a* with conductor piece 16 the relation may be reversed, with resiliency of leg piece 26 being utilized and conductor piece 16 being made solid. These embodiments are shown in FIGS. 9 and 10, in which L-shaped conductor pieces 18 and 19 both are made so as to have no flexibility until up to the upper end portion. Instead, the leg piece 26 is made of synthetic resin as one body with cover plate 7, having substantial length as compared with its thickness, and hence having sufficient elastic flexibility, and between it and solid conductor place 18 and 19 there can be interposed the end portion of lead wire 6*a* in the resiliently pressed condition. While the conductor piece 19 in FIG. 10 is formed in the same way as in the aforementioned embodiment, as one body continuously with the base plate portion of bearing piece 10, the conductor piece 18 in FIG. 9 is provided separate from bearing piece 10. Therefore, in case of FIG. 9 in order to electrically conduct out the bearing piece 10 to the exterior, a terminal piece 20 is provided centrally on the lower surface of case 1, and bearing piece 10 and terminal piece 20 are mutually fixed by a rivet.

In the case of FIGS. 2 and 10, two wires from an electric source are connected to the left side front and rear terminal pieces 13, and two wires to the load are connected to the right side front and rear terminal pieces 14. Therefore, in the shown condition, at the same time that the load is on, the lamp 6 is lighted, and when actuator 3 is inclined to the opposite side, the load becomes off and at the same time lamp 6 is extinguished. In case of FIG. 9, the electric source is connected to the central front and rear terminals 20, and the left and right side front and rear terminals 13 and 14 are connected to separate loads, which are changed over in response to the operation of actuator 3, and lamp 6 is lighted "on" and "off" at the same time as the "on" or "off", respectively, of the right side load. By the way, in case of FIG. 9, the load circuit and the lamp circuit may be constructed independently of each other, and any other circuitry changes may be performed. Alternatively, in addition to the total six terminal pieces including the left and right, front and rear ones for the changing-over of load circuits, two terminals exclusive for the lamp circuit may be provided. Further, as conductor pieces for conducting out lead wires of the lamp may be used vertical straight plates which are projected through the base wall of case 1 and fixed thereto, and the lower end portions of which are utilized as terminal pieces.

In FIGS. 2 and 3, on one side of the upper surface portion 3*a* of actuator 3 there is opened a window hole 3*d* on which a light-passing member 3*e* is fitted. That is, in this case, the actuator 3 per se is made of light-interrupting material, and only the portion of transparent member 3*e* is illuminated by lamp 6 disposed just thereunder. Further, if the cover 7 including its rising piece 21 is made of white or a highly reflective color or substance, the illumination effect is enhanced, especially also be the reflection on the inner surface of rising piece 21 the illumination effect is enhanced to some extent. Furthermore, in order to make bright only the portion of transparent member 3*e*, the whole of actuator 3 may be made of light passing material with its front or back surface being coated by light-interrupting point. In this case one may omit opening a hole 3*d*, with this portion only being left not coated by the opacifying paint.

Although the above embodiments have been described as a wave-form switch, the invention can be similarly applied to a push button switch and the like.

According to the invention, such favorable effects are obtained that the light emitter for illuminating the actuator can be stably mounted at its most desirable position for the illumination, and also its mounting operation is easy; further, there is no fear that the lead wires of the light emitter would be broken by vibration or the like.

I claim:

1. An illumination-type small-sized switch which comprises a switch case containing therein switch contacts;

an actuator rockably positioned above said switch case;

a light emitter disposed under said actuator for illuminating the same; and an insulating plate placed on the upper surface of said switch case for supporting said light emitter, said insulating plate having a circular opening and being formed on its upper surface with a resilient cylinder-shaped rising piece surrounding said opening, and said light emitter being fitted into said rising piece.

2. A switch as defined in claim 1, in which said rising piece is provided on its side surface with a fold.

3. A switch as defined in claim 1, in which said rising piece is provided on its side surface with a split.

4. A switch as defined in claim 1, in which said actuator is made of opaque material and has a window which is closed by a light-transmitting member detachably fitted thereon.

5. An illumination-type small-sized switch comprising a switch case containing therein switch contacts;

an actuator rockably positioned above said switch case;

a light-emitter disposed under said actuator for illuminating said actuator;

lead wires from a source of electrical current to said light emitter;

an insulating plate placed on the upper surface of said switch case and formed on its upper surface with a resilient rising piece which has a vertically penetrating bore, said light-emitter being fitted into said bore and the lead wire of said light-emitter being conducted out downwardly from said insulating plate.

6. An illumination-type small-sized switch comprising a switch case containing therein contacts;

an actuator rockably positioned above said switch case;

a light emitter disposed under said actuator for illuminating the same;

an insulating plate placed on the upper surface of said switch case for supporting said light-emitter by fitting the same into a hole of said plate;

a leg piece projecting on the lower surface of said insulating plate adjacent said hole, the lead wire of said light-emitter being placed along the surface of said leg piece; and a conductor piece mounted on the switch case, the end portion of said lead wire being resiliently in contact with said conductor piece.

7. A switch as defined in claim 6, in which said leg piece has along its length a groove for guiding the lead wire of said light emitter.

8. A switch as defined in claim 6, in which said conductor piece is secured to the switch case together with a member for bearing a movable contact piece of the switch.

* * * * *